US010266307B1

(12) United States Patent
McAtarian et al.

(10) Patent No.: US 10,266,307 B1
(45) Date of Patent: Apr. 23, 2019

(54) EQUIPMENT BAG WITH CLOSURE SLEEVE

(71) Applicant: Andax Industries LLC, St. Mary's, KS (US)

(72) Inventors: Patrick F. McAtarian, St. Mary's, KS (US); Mark McAtarian, St. Mary's, KS (US)

(73) Assignee: Andax Industries LLC, St. Mary's, KS (US)

( * ) Notice: Subject to any disclaimer, the term of this patent is extended or adjusted under 35 U.S.C. 154(b) by 0 days.

(21) Appl. No.: 15/951,330

(22) Filed: Apr. 12, 2018

(51) Int. Cl.
*B65D 33/06* (2006.01)
*B65D 81/26* (2006.01)
*B65D 85/30* (2006.01)

(52) U.S. Cl.
CPC ..... *B65D 33/06* (2013.01); *B65D 81/264* (2013.01); *B65D 85/30* (2013.01)

(58) Field of Classification Search
CPC ..... B65D 33/06; B65D 81/264; B65D 85/30
USPC ..... 383/26, 10, 80, 110, 100–103, 71, 76
See application file for complete search history.

(56) References Cited

U.S. PATENT DOCUMENTS 2,426,475 A * 8/1947 Van Frank ..... B65D 81/18 150/901
3,060,987 A * 10/1962 Adams ..... B65D 88/1637 383/19
3,870,358 A * 3/1975 Bennett ..... B66C 1/18 294/77
4,390,051 A * 6/1983 Cuthbertson ..... B65D 88/1618 294/74
4,468,933 A * 9/1984 Christopher ..... A45C 11/20 383/110
5,192,134 A * 3/1993 Polett ..... B65D 88/1618 383/105
5,251,460 A * 10/1993 DeMarco ..... B65D 81/3886 220/592.19
5,344,109 A 9/1994 Hokoana, Jr.
5,524,949 A 6/1996 Mooney
(Continued)

FOREIGN PATENT DOCUMENTS

CN 206691639 U 12/2017
DE 10114892 C1 10/2002
(Continued)

OTHER PUBLICATIONS

"Big Orange Bag" Single-Use Pole Mount Transformer Bags product description—see www.abgbag.com.
(Continued)

*Primary Examiner* — Jes F Pascua
(74) *Attorney, Agent, or Firm* — Hovey Williams LLP

(57) ABSTRACT

An equipment containment and transport assembly (20, 120) includes an open-top equipment-receiving primary bag (22, 122) having upstanding sidewall structure (26, 126) equipped with lifting lug openings (30, 130), and a bottom wall (28, 128). The assembly (20, 120) further has a flexible sleeve (24, 124), which is secured to the sidewall structure (26, 126) and is shiftable between a ready position surrounding the sidewall structure (26, 126) and a deployed position extending upwardly for closure or the assembly (20, 120). When deployed, the sleeve (24, 124) covers the lug openings (30, 130). The assembly (20, 120) is particularly useful for containment and shipping of electrical transformers.

19 Claims, 5 Drawing Sheets

(56) References Cited

U.S. PATENT DOCUMENTS

| | | | | |
|---|---|---|---|---|
| 5,667,266 | A | 9/1997 | Giocanti | |
| 6,027,249 | A * | 2/2000 | Bielinski | B65D 81/3897 150/156 |
| 6,494,341 | B2 | 12/2002 | Perkins et al. | |
| 6,499,781 | B1 | 12/2002 | Flynn | |
| 8,011,500 | B2 | 9/2011 | Lee | |
| 8,777,001 | B1 | 7/2014 | Bennett | |
| 9,578,937 | B2 | 2/2017 | Kern et al. | |
| 2014/0177980 | A1 | 6/2014 | Diao | |

FOREIGN PATENT DOCUMENTS

| | | | |
|---|---|---|---|
| EP | 2039620 | B1 | 9/2010 |
| GB | 2076780 | A | 12/1981 |
| RU | 2132296 | C1 | 6/1999 |

OTHER PUBLICATIONS

"Xtra HD Transformer Sac" product description—found online at https://linestar.ca/specialty-items/transformer-containment/pad-pole-mount/xtra-hd-transformer-sac/.

* cited by examiner

EQUIPMENT BAG WITH CLOSURE SLEEVE

BACKGROUND OF THE INVENTION

Field of the Invention

The present invention is concerned with equipment containment bag assemblies designed to provide environmentally safe shipping and storage conditions for leaking or otherwise non-performing equipment, such as pole-mounted distribution transformers, switchgear, breakers, and reclosers. More particularly, the invention is concerned with such bag assemblies, and methods of use thereof, wherein the assemblies include primary, open-top, equipment-receiving bags with access openings for the equipment lifting lugs, and with associated tubular sleeves designed for closure to effectively envelope the equipment in an environmentally friendly package, while nevertheless permitting lifting of the equipment using the lifting lugs thereof.

Description of the Prior Art

Conventional electrical transformers used in power distribution systems include a sealed, oil-filled tank with internal electrical components, such as transformer coils. These transformers also have external hardware, such as mounting equipment, connection busses, and lifting lugs. These transformers are subject to leaking over time, resulting from damage to the transformer tank or from extended use. Such leakages can be environmentally damaging, inasmuch as the oil formulations within the transformers can often include hazardous chemicals (e.g., PCBs). In any event, it is necessary to safely transport failed transformers for disposal or repair, in accordance with governmental regulations. In like manner, other types of equipment, and especially electrical utility equipment, require safe and effective containment and shipping enclosures.

A number of different transformer containment devices have been provided in the past. For example, Andax Industries LLC has commercialized Xtra HD Pole-Mount Transformer Sac™ containment bags, which have large, puncture-proof transformer bags with opposed perforated sections which can be opened to allow access to transformer lifting lugs. However, these bags do not provide any closures for these openings, and accordingly moisture or contaminants can enter the bags.

U.S. Pat. No. 8,777,001 describes another type of transformer containment bag which includes a bag with an internal liner and external lifting hoops. These kinds of bags are deficient, and indeed do not meet relevant regulatory standards, because the lifting lugs of the transformers cannot be accessed, thus requiring that the transformers be elevated and moved using only the bag components, which places considerable stress on the overall assemblies.

SUMMARY OF THE INVENTION

The present invention overcomes the problems outlined above and provides equipment containment and shipping bag assemblies which allow lifting and handling of equipment having lifting lugs via strategically located lug-access bag openings, while also preventing contamination of the assemblies and the equipment therein through the lug openings. As used herein, "lifting lugs" or "lugs" refers to any type of integrated lifting point(s) associated with the equipment to allow safe lifting and transport thereof. Such bag assemblies generally comprise a primary bag including upwardly extending sidewall structure having an upper margin, and a bottom wall secured to the sidewall structure to present an equipment-receiving container, with the sidewall structure having a pair of opposed openings oriented to permit passage of the equipment lifting lugs therethrough. The assemblies also include a flexible tubular sleeve secured to the primary bag and movable between a ready position surrounding the primary bag sidewall structure, and a deployed position extending upwardly above the upper margin of the primary bag. When deployed, the sleeve has a first, lower sleeve portion covering the opposed lug openings, and a second, upper sleeve portion above the first sleeve portion permitting duffel closure of the primary bag with equipment therein.

The sleeve may be secured to the primary bag at points below or above the opposed openings, and in both cases the second sleeve portion is integral with and is in effect a continuation of the first lower sleeve portion. The primary bag sidewall structure is preferably formed of a flexible, puncture-resistant synthetic resin material, and has a height greater than the height of the equipment. In order to provide a more rugged construction, the bottom wall of the primary bag has a thickness greater than that of the sidewall structure. The bag and sleeve may be substantially circular in cross-section, or any other shape required to accommodate different equipment designs.

The invention also provides a method of handling equipment, which comprises first placing the equipment within a primary bag of a bag assembly, the primary bag including upwardly extending sidewall structure having an upper margin, a bottom wall secured to the sidewall structure, and a pair of opposed openings through the sidewall structure. The assembly further has a flexible tubular sleeve secured to the primary bag and located in surrounding relationship about the sidewall structure; as used herein, "tubular" is intended to refer to any appropriate cross-sectional shape, such as circular, oval, or quadrate, for example. Next, the equipment and/or bag assembly are manipulated so that the lifting lugs protrude through the opposed openings, allowing safe lifting of the equipment using these lugs. Once the equipment is safely positioned, the sleeve is shifted from its ready position so that a first lower portion thereof covers the opposed lug openings, and a second upper sleeve portion extends above the upper margin of the primary bag. This upper sleeve portion is then closed by tying or the like.

BRIEF DESCRIPTION OF THE DRAWINGS

While the drawings do not necessarily provide exact dimensions or tolerances for the illustrated components or structures, FIGS. 1-12 are to scale with respect to the relationships between the components of the structures illustrated therein.

DETAILED DESCRIPTION OF THE PREFERRED EMBODIMENTS

The following description is directed to two specific embodiments of the present invention, each being a transformer bag assembly having a primary bag and a flexible tubular sleeve secured to the primary bag for the purposes described. It should be understood, however, that these embodiments are provided by way of illustration only, and nothing therein should be taken to represent a limitation upon the overall scope of the invention.

Embodiment of FIGS. 1-4

Figure 2:
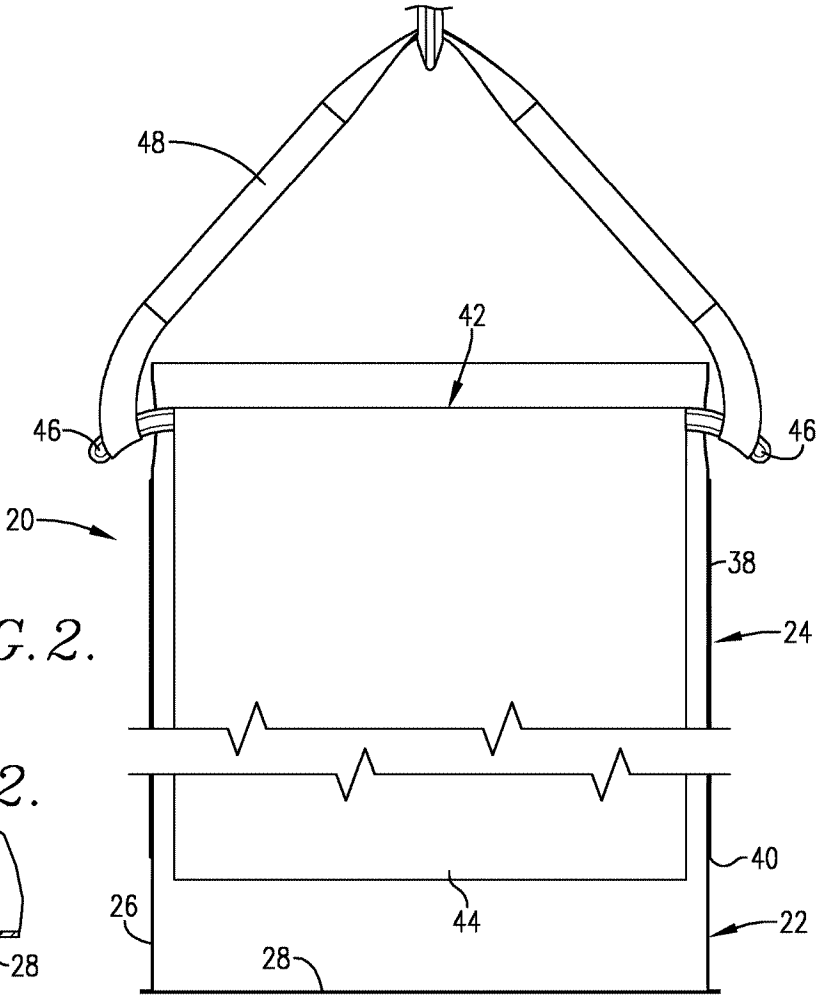
FIG. 2 is a fragmentary vertical sectional view of the bag assembly illustrated in FIG. 1.
Figure 1:
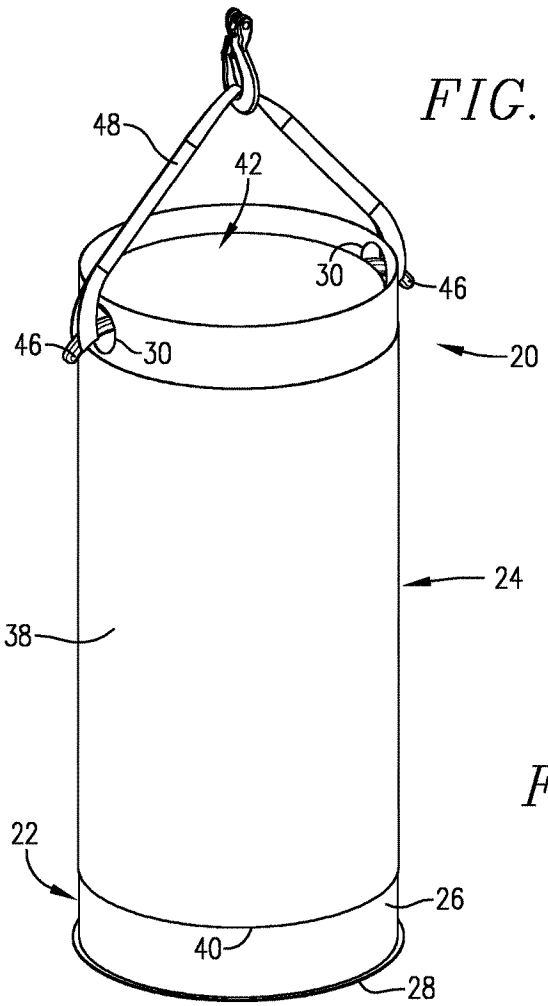
FIG. 1 is a perspective view of a transformer bag assembly in accordance with a first embodiment of the invention, illustrated with a primary bag and a separate tubular sleeve, with the sleeve in its lowered, ready position with the lugs of a transformer within the primary bag extending through bag openings, and with a lift strap secured to the lugs.
Figure 4:
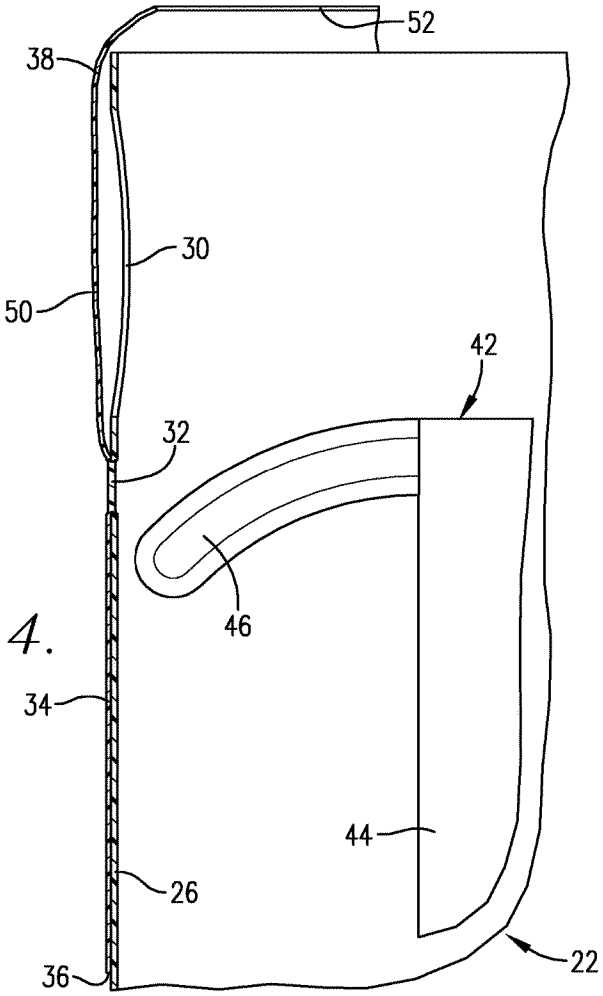
FIG. 4 is an enlarged partial vertical sectional view similar to that of FIG. 3, but illustrating the transformer wholly within the confines of the bag assembly and with the sleeve in its raised, deployed position.
Figure 3:
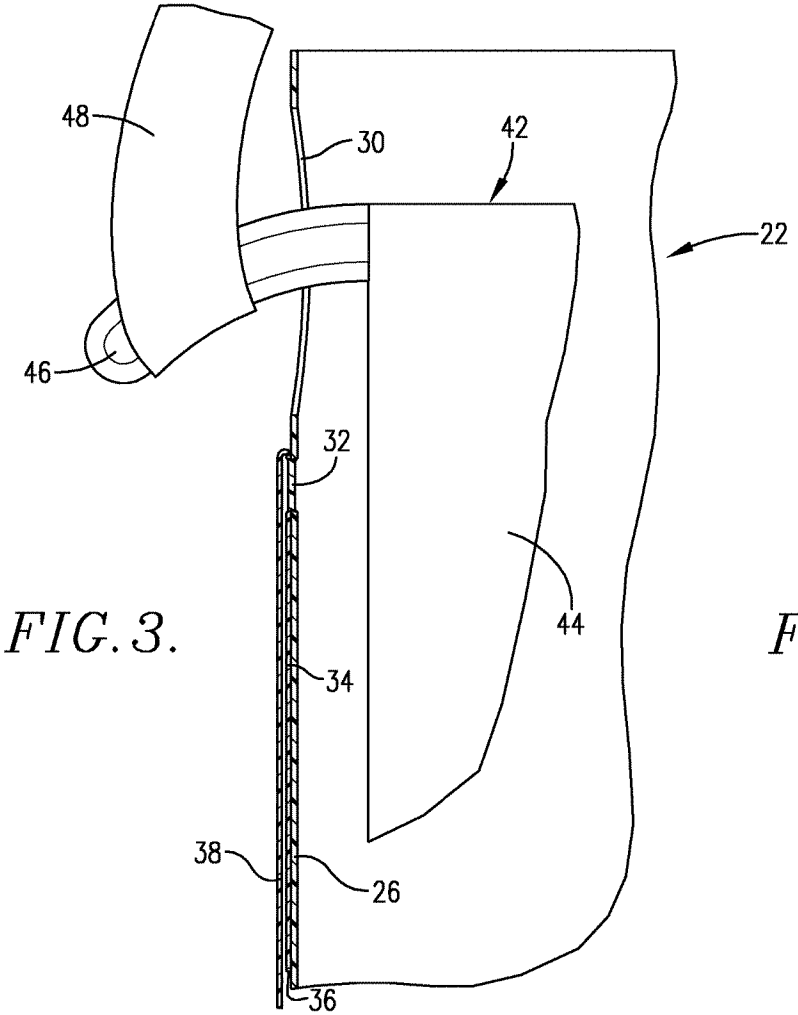
FIG. 3 is an enlarged, partial vertical sectional view of the FIG. 1 bag assembly, illustrating the construction of the tubular sleeve and its orientation in the ready position thereof.

A transformer bag assembly 20 is illustrated in FIGS. 1-2, and generally includes an upright, open-top primary bag 22 and a flexible tubular sleeve 24, which is separate from the bag 20, but operably secured to the latter. As depicted, the primary bag 22 includes upstanding sidewall structure 26 with a bottom wall 28 secured thereto. The sidewall structure 26 is provided with a pair of opposed openings 30, which are important for purposes to be described. The sleeve 24 is of unitary construction and is attached to the outer surface of sidewall structure 26 immediately below the openings 30 along a circumferential fusion or bond line 32; such bonding may be effected by heat welding or chemical bonding, for example. As best seen in FIGS. 3-4, the bond line 32 is intermediate the opposed ends of the sleeve 24 so that a depending flap section 34 is defined between the bond line 32 and the adjacent edge 36 of the sleeve 24. A significantly longer bag closure section 38 extends from bond line 32 to the opposite edge 40 of the sleeve 24.

The primary bag 22 is designed to hold an electrical transformer 42 for handling and shipping thereof. The transformer 42 is itself entirely conventional and includes an upright tank 44 containing oil and electrical components. The transformer 42 would also typically include other external hardware such as mounting lugs and connection bushings (not shown). A pair of oppositely outwardly extending lifting lugs 46 are secured to the tank 44 and are designed for safe lifting and handling of the transformer.

In the use of bag assembly 20, the transformer 42 is first detached from its normal mounting (e.g., a utility pole) and suspended via the lugs 46 using a lift strap 48 or the like; the primary bag 22 is then preliminarily placed about the suspended transformer 42. It will be observed (FIG. 2) that the length of the sidewall structure 26 is such that there is a space between the base of the transformer and bottom wall 28. As such, the bag assembly 20 is not placed under any load during lifting of the transformer 42; rather, the bag assembly serves merely as a containment device. The transformer and partially applied assembly 20 are then placed on a stable surface, such as a truck bed, and the lift strap 48 is removed. Then, the bag 22 is further manipulated so that the lugs 46 protrude through the openings 30, and the sleeve 24 is in its ready position, so that the transformer and assembly 20 can be further moved as desired using strap 48. Once the transformer is in a secure transport or storage position, the sleeve 24, and particularly the closure section 38 thereof, is elevated above the open end of the bag 22 and closed. If desired, the bag 22 can be manipulated so that the lugs 46 are entirely within the confines of bag 22 (FIG. 4). Closure of section 38 may be effected by any conventional means, such as by gathering the section 38 and tying it off. It will be seen that a first, lower portion 50 of the closure section 38 covers the openings 30, whereas a second, upper portion 52 is above the open top of the primary bag 22, for closure purposes; as such, the portions 50, 52 are integral and the portion 52 is simply a continuation of the portion 50.

Figure 12:
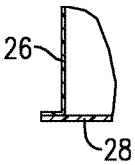
FIG. 12 is a partial sectional view illustrating the attachment of the bottom wall of a bag assembly in accordance with the invention, with the bottom wall secured to the upstanding sidewall structure of the primary bag.

In order to provide a rugged primary bag 22, it is desirable to form the bottom wall 28 of a thicker material, as compared with sidewall structure 26 (FIG. 12). Again, the bottom wall 28 may be affixed by heat welding or other secure bonding. Additionally, the upper surface of the bottom wall may be provided with an absorbent material (not shown) to absorb oil or other liquids leaking from transformer tank 44.

Embodiment of FIGS. 5-11

Figures 5, 6, 7:
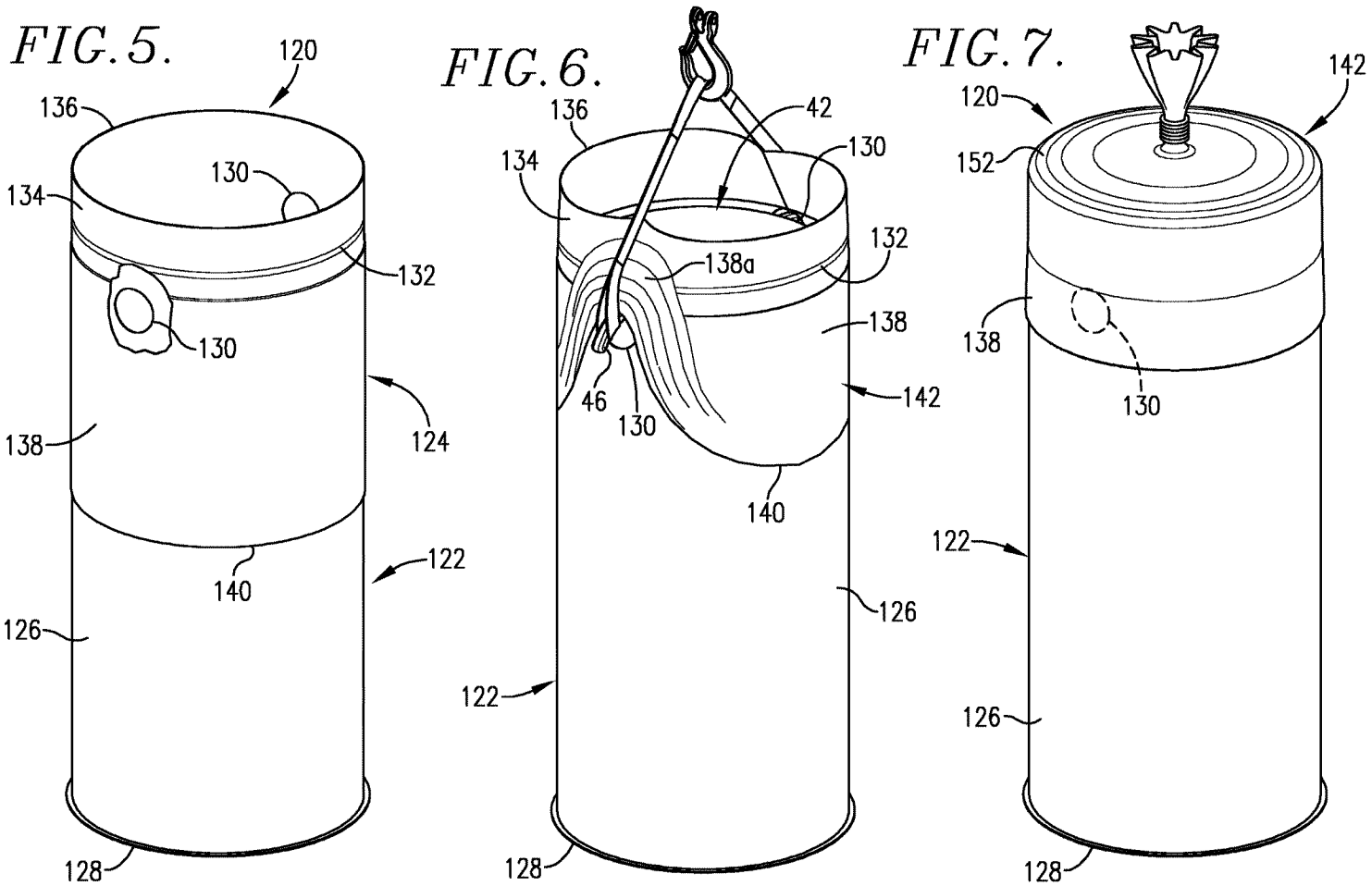
FIG. 5 is a perspective view of a transformer bag assembly in accordance with a second embodiment of the invention, illustrated with the tubular sleeve thereof in its lowered, ready position and with a portion of the sleeve broken away to depict the lifting lug openings through the primary bag wall.
FIG. 6 is a view similar to that of FIG. 5, but depicting the bag assembly with a transformer therein, having the lifting lugs of the transformer protruding through the primary bag openings and engaged by a lifting strap, with the sleeve in an intermediate, gathered position above the lugs.
FIG. 7 is a view similar to that of FIG. 6, but illustrating the sleeve in its deployed position as a closure for the bag assembly.
Figure 9:
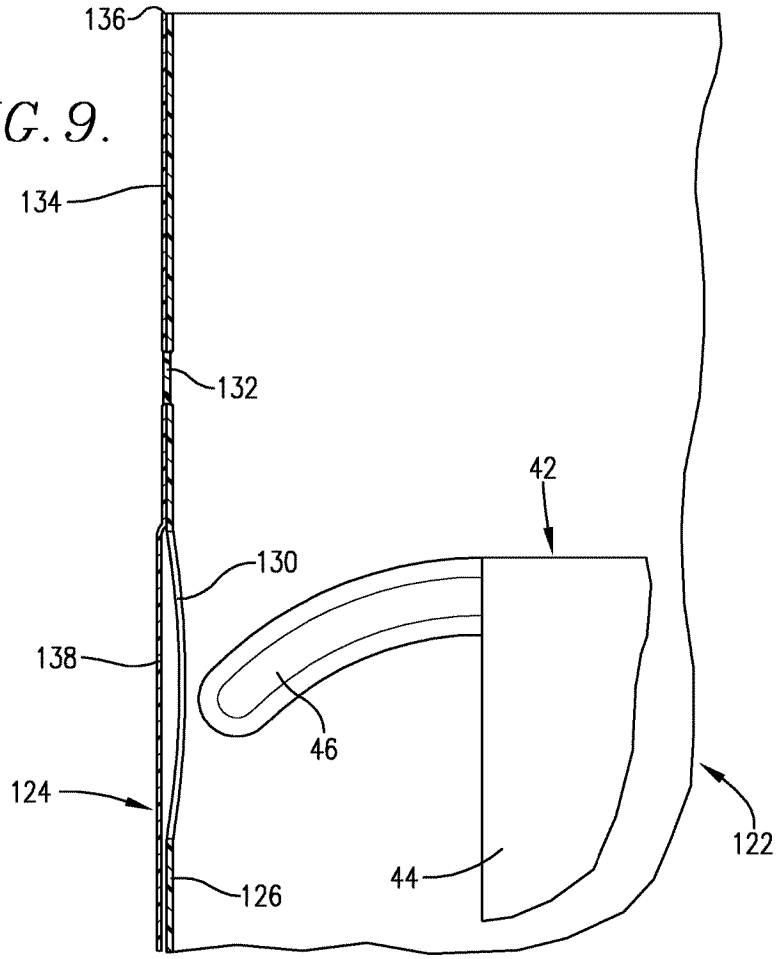
FIG. 9 is a view similar to that of FIG. 8, but illustrating the transformer wholly within the confines of the bag assembly.
Figure 8:
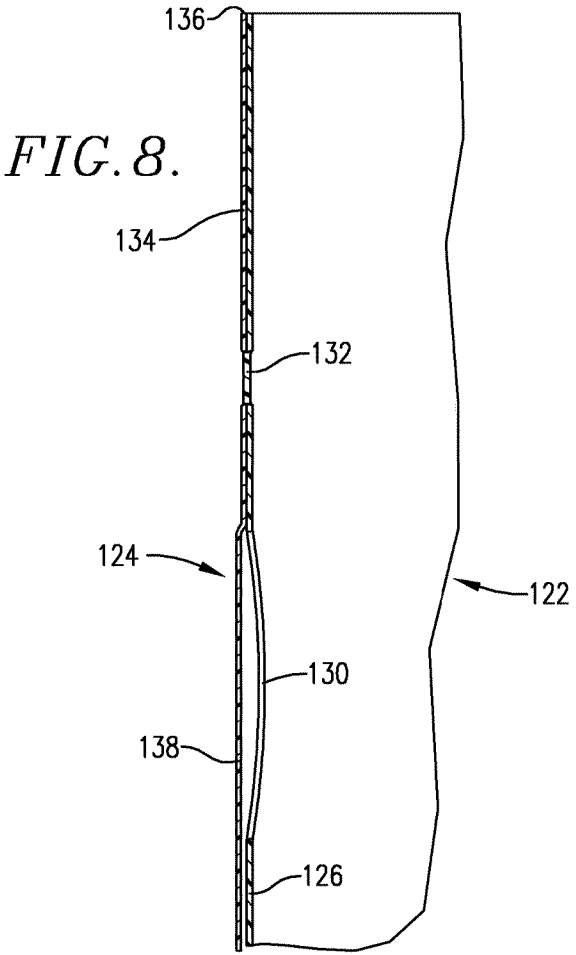
FIG. 8 is an enlarged, partial vertical sectional view of the embodiment of FIG. 5, depicting the sleeve in its lower, ready position in covering relationship to one of the primary bag openings.

A transformer bag assembly 120 is depicted in FIGS. 5-11 and is used in the same manner as the assembly 20 for the containment and handling of a transformer 42, as previously described. Generally, the assembly 120 includes an upright, open-top primary bag 122 and a flexible tubular sleeve 124, which is separate from the bag 120, but secured to the latter. As depicted, the primary bag 122 includes upstanding sidewall structure 126 with a bottom wall 128 secured thereto. The sidewall structure 126 is provided with a pair of opposed, lug-receiving openings 130. The sleeve 124 is of unitary construction and is attached to the outer surface of sidewall structure 126 immediately above the openings 130 along a circumferential fusion or bond line 132. As best seen in FIGS. 8-9, the bond line 132 is located adjacent the upper end of the sleeve 124 so that an upwardly extending flap section 134 is defined between the bond line 132 and the adjacent edge 136 of the sleeve 124. A significantly longer bag closure section 138 extends downwardly from bond line 132 to the opposite edge 140 of the sleeve 124 (FIGS. 5 and 6).

Figure 11:
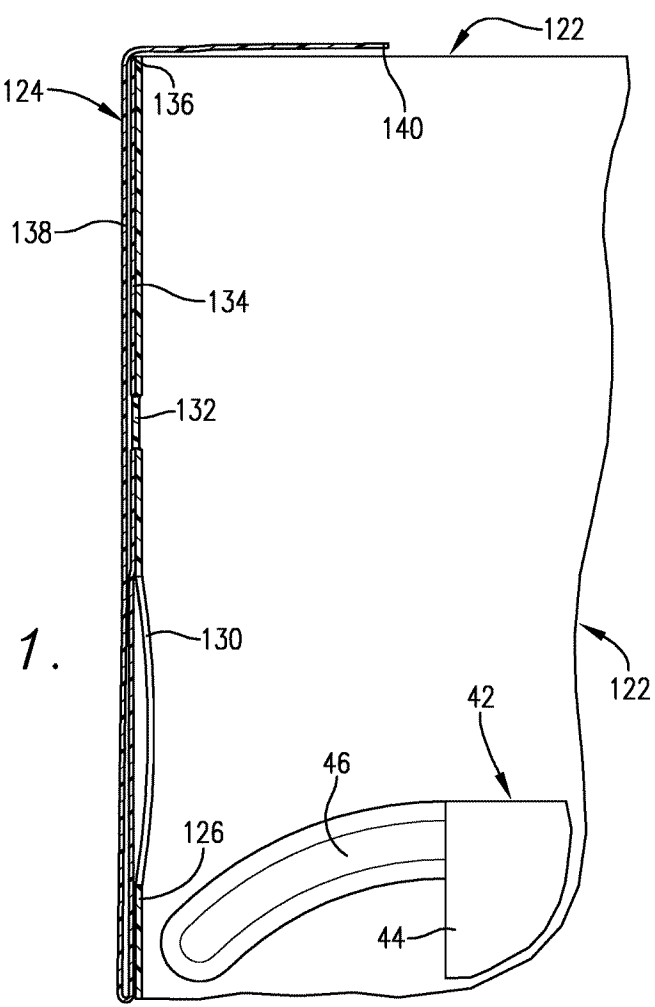
FIG. 11 is an enlarged, partial vertical sectional view illustrating the sleeve in its ready position with a transformer wholly within the confines of the bag assembly.
Figure 10:
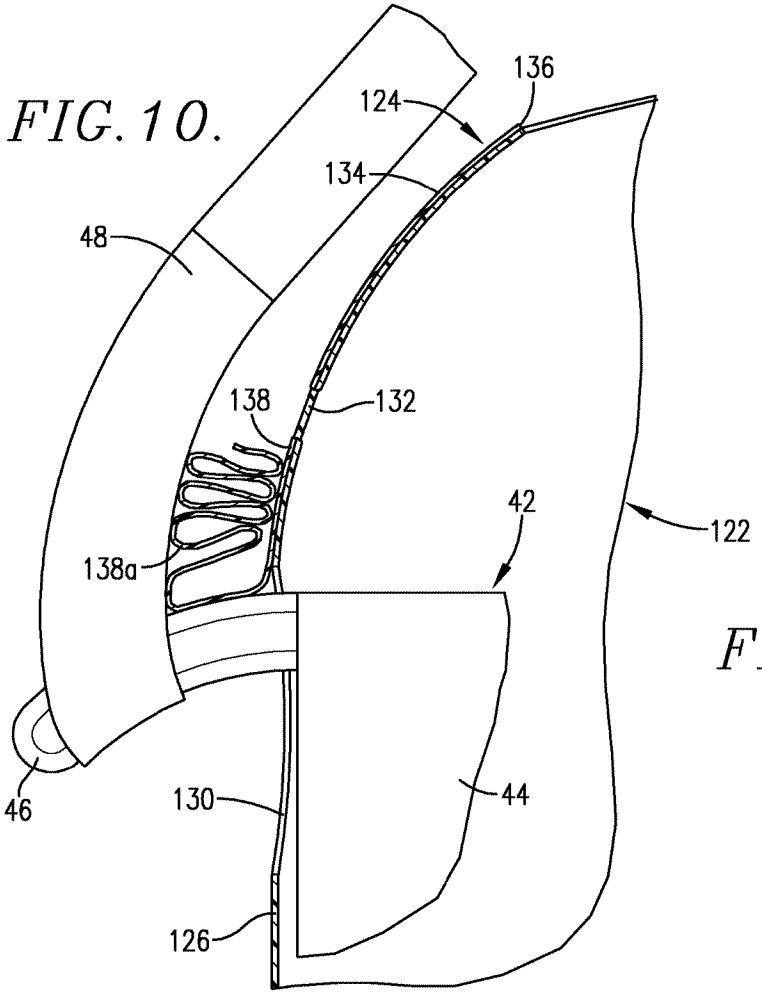
FIG. 10 is an enlarged, partial vertical sectional view illustrating the bag assembly and transformer in the FIG. 6 position, and further illustrating the gathering of the sleeve during lifting of the transformer and bag assembly.

Just as before, the primary bag 122 is first placed about transformer 42 after the latter is detached from its regular mounting and suspended via lugs 46. Next, the primary bag 122 is preliminarily installed over the transformer 42 and the latter are placed on a stable surface. The bag 122 is then manipulated so that the lugs 46 protrude through the openings 130, allowing further lifting and handling of the transformer 42 as necessary. Once the transformer and slide assembly 120 are in secure location with lugs 46 protruding through the openings 130, the section 138 is gathered at 138*a* and placed atop the lugs and adjacent the flap 134 (FIGS. 6 and 10). Thereupon, a lift strap 48 or the like is then operably secured with the lugs 46, allowing the entire transformer 42 and bag assembly 120 to be lifted and transported. Again, the bag assembly 120 is not placed under any load during lifting of the transformer 42; rather, the bag assembly 120 serves merely as a containment device. Once the transformer 42 is positioned as desired, the sidewall structure 126 is manipulated so as to confine the entirety of the transformer 42, including lugs 46, within the primary bag 122. At this point, the sleeve 124 is drawn upwardly and tied off above transformer 42, as shown in FIG. 7. The section 138, below the tie-off, drapes downwardly so that the lower end thereof covers the openings 130, as best seen in FIG. 11.

In both of the above embodiments, the sidewall structures 26, 126, bottom walls 28, 128, and sleeves 24, 124 may be formed of any desired flexible material. Particularly preferred are coextruded and reinforced synthetic resin materials, such as polyethylenes and polyurethanes, having a thickness of from about 5-20 mils. Additionally, while the primary bags 22 and 122, and the associated sleeves 24 and 124 are illustrated as being substantially circular in cross-section, it will be appreciated that other shapes may be employed, depending upon the types of transformers to be handled. Furthermore, while the embodiments were described such that the transformer lugs 46 could be moved entirely within the confines of the primary bags, such is not necessary; rather, the bag assemblies could be configured so that the lugs 46 remain at least partially outside the primary bags, and, in these instances, the lower portions of the sleeves would be sized to accommodate these protruding lugs. Finally, while the sleeves 24, 124 are illustrated as being structurally separate but secured to the primary bags 22, 122, the latter could be manufactured to include integral sleeves.

We claim:

1. A bag assembly for equipment having a pair of opposed lifting lugs, said bag assembly comprising:

a primary bag including upwardly extending sidewall structure having an upper margin, and a bottom wall secured to the sidewall structure to present an equipment-receiving container, said sidewall structure having a pair of opposed openings oriented to permit passage of said lifting lugs therethrough; and a flexible tubular sleeve secured to said primary bag and movable between a ready position surrounding said sidewall structure, and a deployed position extending upwardly beyond said upper margin, said sleeve in the deployed position thereof having a first, lower sleeve portion covering said opposed openings, and a second, upper sleeve portion above said first sleeve portion permitting closure of the primary bag with said equipment therein.

2. The bag assembly of claim 1, said sleeve secured to said primary bag at a point below said opposed openings, said second sleeve portion being a continuation of the first sleeve portion.

3. The bag assembly of claim 1, said sleeve secured to said primary bag at a point above said opposed openings, said second sleeve portion being a continuation of the first sleeve portion.

4. The bag assembly of claim 1, said primary bag configured to permit said lifting lugs to be positioned within the confines of said primary bag.

5. The bag assembly of claim 1, said sidewall structure of a height greater than the height of said equipment.

6. The bag assembly of claim 1, said primary bag and sleeve formed of reinforced synthetic resin material.

7. The bag assembly of claim 1, said bottom wall having a greater thickness than the thickness of said sidewall structure.

8. The bag assembly of claim 1, said primary bag having an open top.

9. The bag assembly of claim 1, said primary bag being substantially circular in cross-section.

10. A method of handling equipment having a pair of opposed lifting lugs, said method comprising the steps of:

placing said equipment within a primary bag of a bag assembly, said primary bag including upwardly extending sidewall structure having an upper margin, a bottom wall secured to said sidewall structure, a pair of opposed openings through the sidewall structure, said assembly further including a flexible tubular sleeve secured to said primary bag and located in surrounding relationship about the sidewall structure;

positioning said equipment and/or primary bag so that said lifting lugs protrude through said opposed openings;

lifting said equipment and primary bag using said protruding lifting lugs;

shifting said sleeve so that a first lower portion thereof covers said opposed openings, and with a second upper sleeve portion extending above the upper margin of said primary bag; and using said second upper sleeve portion to close said primary bag with said equipment therein.

11. The method of claim 10, said sleeve secured to said primary bag at a point below said opposed openings, said second sleeve portion being a continuation of the first sleeve portion.

12. The method of claim 10, said sleeve secured to said primary bag at a point above said opposed openings, said second sleeve portion being a continuation of the first sleeve portion.

13. The method of claim 10, including the step of, after said lifting step, positioning said equipment and/or primary bag so that said lugs are positioned within the confines of said primary bag.

14. The method of claim 10, said sidewall structure of a height greater than the height of said equipment.

15. The method of claim 10, said primary bag and sleeve formed of reinforced synthetic resin material.

16. The method of claim 10, said bottom wall having a greater thickness than the thickness of said sidewall structure.

17. The method of claim 10, said primary bag having an open top.

18. The method of claim 10, said primary bag being substantially circular in cross-section.

19. The method of claim 10, said equipment comprising a transformer.

* * * * *